United States Patent [19]

Billet et al.

[11] Patent Number: 5,062,222

[45] Date of Patent: Nov. 5, 1991

[54] SHOE OR BOOT HAVING A HEATING DEVICE

[75] Inventors: Philippe Billet, Annecy-le-Vieux; Jean-Louis Demarchi, Duingt, both of France

[73] Assignee: Salomon S.A., Annecy Cedex, France

[21] Appl. No.: 409,457

[22] Filed: Sep. 19, 1989

[30] Foreign Application Priority Data

Sep. 19, 1988 [FR] France ..... 88 12197

[51] Int. Cl.[5] ..... A43B 7/02

[52] U.S. Cl. ..... 36/2.6; 36/117

[58] Field of Search ..... 36/2.6, 50, 117, 137, 36/139

[56] References Cited

U.S. PATENT DOCUMENTS

| | | | |
|---|---|---|---|
| 51,492 | 12/1865 | Taft | 36/2.6 X |
| 156,117 | 10/1874 | Angresius | 36/2.6 |
| 3,585,736 | 6/1971 | Pouchena | 36/2.6 |
| 3,663,796 | 5/1972 | Hines et al. . | |
| 3,977,093 | 8/1976 | Santroch . | |
| 4,023,282 | 5/1977 | Ziegelhafer | 36/2.6 |
| 4,180,922 | 1/1980 | Cieslak et al. . | |
| 4,579,103 | 4/1986 | Poffenbarger | 36/2.6 X |
| 4,685,442 | 8/1987 | Coeslak | 36/2.6 X |
| 4,736,530 | 4/1988 | Lakic et al. . | |
| 4,780,968 | 11/1988 | Bragagnolo | 36/2.6 |
| 4,798,933 | 1/1989 | Annovi | 36/2.6 X |

FOREIGN PATENT DOCUMENTS

| | | | |
|---|---|---|---|
| 0146792 | 7/1985 | European Pat. Off. . | |
| 146353 | 11/1903 | Fed. Rep. of Germany | 36/2.6 |
| 2080146 | 10/1971 | France . | |
| 1136269 | 1/1980 | Italy . | |
| 196850 | 2/1984 | Italy . | |
| 58393 | 9/1911 | Switzerland | 36/2.6 |
| 1223883 | 4/1986 | U.S.S.R. | 36/2.6 |
| 8605663 | 10/1986 | World Int. Prop. O. | 36/2.6 |

*Primary Examiner*—Paul T. Sewell
*Assistant Examiner*—BethAnne Cicconi
*Attorney, Agent, or Firm*—Sandler, Greenblum, & Bernstein

[57] ABSTRACT

A shoe or boot, particularly for downhill or cross-country skiing, having a foot support zone, a sole, and an upper, in which the shoe or boot has a heating assembly located proximate the sole. The heating assembly includes a heating device such as a catalytic burner for producing heat, a plate for diffusion of the heat, the plate being located proximate the foot support zone, a source of fuel, a supply circuit for feeding fuel to the heating device, a valve for regulating the feeding of fuel to the heating device, and a heating control device, wherein the fuel source includes an interchangeable fuel cartridge, and wherein the interchangeable fuel cartridge is received and held on the upper of the shoe or boot.

48 Claims, 6 Drawing Sheets

SHOE OR BOOT HAVING A HEATING DEVICE

BACKGROUND OF THE INVENTION

1. Field of the Invention

The present invention relates to a shoe or boot provided with a heating device, particularly intended for downhill or cross-country skiing.

2. Description of Background Information

Ski shoes or boots are known which are intended to improve the comfort of the wearer by means of the incorporation of heating devices. These devices include the electric type, which use a heating resistance, and the liquid or gaseous fuel type, which use a reservoir of fuel and a burner positioned in the shoe or boot. The heating devices having liquid or gaseous fuel are advantageous, compared to electric devices, in making it possible to obtain a greater autonomy, making them more convenient, and to ensure, during a relatively long period of time, a desired level of comfort of the shoe or boot with regard to the temperature.

Heating devices using a liquid fuel, such as those described, for example, in Italian Patent No. 1,136,269 and French Patent No. 2,080,146, generally comprise a burner having rechargeable liquid fuel, which is positioned under a heat diffusion plate incorporated into the sole of the shoe or boot so as to extend as close as possible to the foot of the wearer of the shoe or boot. Other heating devices which use a gaseous fuel comprise a reservoir of gas which feed, through a valve, a catalytic burner, all of these elements being likewise totally positioned within the sole of the shoe or boot.

Such heating devices having gaseous fuel are described, for example, in Italian Design No. 196,850 and in International Patent Application WO 86/05663. Heating devices using gaseous fuel are of the type having a rechargeable gas reservoir and it is consequently necessary to provide, in the sole of the shoe or boot which contains the reservoir, an orifice through which the internal gas reservoir can be connected to an external recharging source of external gas.

The types of heating devices having liquid or gaseous fuel do have a disadvantage, however, in that the periodic filling of the fuel reservoir is required. This constitutes an inconvenient operation and particularly requires positioning near a combustible source to enable the recharging of the reservoir when the need arises Thus it is clear that the operation of filling the reservoir cannot be carried out easily and in certain circumstances can be very inconvenient and impractical, such as, for example, when the wearer is engaged in an outdoor sport, such as skiing, and he or she is in the middle of the mountain and the temperature is particularly low.

SUMMARY OF THE INVENTION

It is, therefore, an object of the present invention to improve upon the efficiency of heated shoes or boots, particularly downhill and cross-country ski boots, and to increase the convenience of operation and use of such boots.

To this end, the boot of the present invention includes a heating assembly, at least a portion of which is located proximate the sole, the heating assembly including a catalytic burner for producing heat, a plate for diffusion of the heat, the plate being located proximate the foot support zone, a means for receiving a source of fuel, a supply circuit for feeding the fuel to the catalytic burner, a valve for regulating the feeding of the fuel from the source of fuel to the catalytic burner, and a heating control device, wherein the means for receiving a source of fuel includes means for receiving and holding an interchangeable fuel cartridge provided on the upper of the shoe or boot in position for connecting the interchangeable fuel cartridge to the supply circuit.

According to a particular object of the invention, the means for receiving and holding the interchangeable fuel cartridge include a housing provided on the rear part of the upper of the shoe or boot.

In one embodiment, the fuel cartridge is located within the outer shell. In another embodiment, the fuel cartridge is located exteriorly of the outer shell.

In a particular embodiment of the present invention, the housing for the fuel cartridge is located on the rear spoiler. In a further and alternative embodiment, the housing for the fuel cartridge is molded with the rear spoiler.

According to a particular aspect of the invention, the housing for the fuel cartridge is prismatic or cylindrical and further includes an open upper end through which the fuel cartridge is insertable and which permits a fuel outlet of the fuel cartridge to be directed towards the bottom of the housing.

In a further aspect of one embodiment of the invention, the heating device further includes means for introducing ambient air into the supply circuit for providing a fuel-air mixture for combustion, the means for introducing ambient air being located beneath the housing and downstream of the valve.

According to a further aspect of an embodiment of the invention, the heating device further includes an electrode positioned proximate the catalytic burner and an igniter is functionally connected to the electrode, the igniter is positioned proximate the housing and includes a pusher for activating the igniter, wherein the housing includes an upper end and a cover movably mounted with respect to the upper end of the housing and adapted to engage an upper portion of the fuel cartridge and the pusher of the igniter.

Further according to the present invention, the housing includes a lower end, the shoe or boot further includes a piston slidably mounted in the housing, a compression spring is positioned between the piston and the lower end of the housing, and the valve is positioned in a central part of the piston, the valve having an outlet connected to the means for introducing ambient air into the supply circuit.

According to an additional aspect of the invention, the means for introducing ambient air into the supply circuit communicates with the exterior of the shoe or boot by means of at least one opening provided in the housing, such openings being provided with filtering elements made of a material permeable to air but impermeable to foreign matter, such as snow.

In a particular embodiment of the present invention, the heating assembly further includes: (i) an igniting electrode positioned near the catalytic burner, and (ii) a piezoelectric igniter connected to the igniting electrode, whereby activation of the piezoelectric igniter ignites the igniting electrode. The heating control device includes (i) a control knob which is movable substantially vertically outside the rear part of the upper of the shoe or boot, and (ii) a lug extending through a slot in the rear part of the upper, the control knob being affixed to the lug, the lug being movable among three different positions, the three positions consisting of an extreme upper position I, corresponding to the closure of the valve to prevent the feeding of the fuel to the catalytic burner, an intermediate position II, corresponding to the opening of the valve for permitting the feeding of the fuel to the catalytic burner, and an extreme lower position III, corresponding to the activation of the piezoelectric igniter.

Still further, the valve includes a control arm extending therefrom and the heating control device further includes, within the upper of the shoe or boot, a manual release plate which is generally C-shaped and open towards the rear and which has an upper, generally horizontal wing extending outside of the upper and being included of the lug which supports the control knob. The heating control device further includes a latching plate attached to the manual release plate, the latching plate being generally C-shaped and open towards the rear and having an upper generally horizontal wing. The latching plate, further, supports means for activation of the control arm of the valve for regulating the feeding of the fuel from the interchangeable fuel cartridge. The upper of the shoe or boot further includes a catch, and the latching plate further includes a latching mechanism adapted to cooperate with the catch for holding the valve in an open position. The heating control device further includes a spring positioned to bias the manual release plate and the latching plate upwardly, the manual release plate and the latching plate being linked to one another by means for allowing a limited upward movement of the manual release plate with respect to the latching plate.

Still further according to the present invention, the means for allowing a limited upward movement of the manual release plate with respect to the latching plate includes guide pins provided on one of the plates engaged within slots provided in the other of the plates, the slots being generally vertically aligned.

Further according to the invention, the upper of the shoe or boot includes a projection and the spring extends between the projection and the upper, generally horizontal wing of the manual release plate and the upper, generally horizontal wing of the latching plate.

Still further, each of the plates includes a lower wing which extends beneath the projection of the upper and which is adapted to abut against this projection in the extreme upper position of the lug.

In a still further aspect of the present invention, a spring is located within the valve for biasing the control arm and the valve towards a lower open position wherein the means for activation of the control arm of the valve includes a projecting lug which extends beneath the control arm.

In a still further aspect of the present invention, a support is affixed to the interior of the upper having a projection extending therefrom for supporting an end of the spring, the igniter also being affixed to the support.

In a particular aspect of an embodiment of the invention, the latching mechanism of the latching plate includes a hook and the catch includes a latching spring having the general shape of an inverted U with an upper generally horizontal member which is adapted to be engaged by the hook of the latching plate, the latching spring being affixed to a lower part of the shoe or boot, the manual release plate including a release ramp at a lower end, the release ramp having a shape such that, during downward movement of the manual release plate, the release ramp is adapted to push the upper generally horizontal member of the inverted U of the latching spring to permit the latching hook of the latching plate to disengage from the generally horizontal member of the inverted U of the latching spring.

Further according to the invention, the piezoelectric igniter includes an upper pushing element for activating the igniter and the manual release plate supports, at an upper end, a member in the shape of an angle iron having a generally vertical portion and a generally horizontal portion, the angle iron-shaped member being affixed to the release plate by the generally vertical portion, the generally horizontal portion extending a short distance, in the extreme upper position I of the lug, above the upper pushing element of the piezoelectric igniter.

Still further according to the invention, the piezoelectric igniter includes an upper pushing element for activating the igniter, the manual release plate includes a lower, generally horizontal wing which extends beneath the projection and above the upper pushing element of the piezoelectric igniter, and the manual release plate further includes an upwardly extending lug and wherein the latching plate supports, at its extreme upper part, a latching member which is pivotably mounted on the latching plate, about a generally horizontal and transverse axis, the latching member including a lower arm with which an upper end of the lug is adapted to contact, and an upper arm which extends upwardly and which is adapted to engage a tooth mounted on an internal surface of a rear wall of the upper, the latching member being elastically biased by means of a spring having two ends which are contacted, respectively, to the latching plate and to the latching member such that the upper arm of the latching member is constantly biased against the rear wall of the upper.

According to a still further aspect of the present invention, the heating assembly includes means for automatically maintaining the temperature of the heating assembly at a predetermined level or range.

According to this aspect of the present invention, the means for maintaining the temperature of the heating assembly at a predetermined level or range includes a closed circuit containing a dilatable fluid, the closed circuit including (i) a bulb positioned proximate the catalytic burner at one end of the closed circuit, (ii) a diaphragm actuator at another end of the closed circuit, and (iii) a capillary tube extending between the bulb and the diaphragm, the diaphragm actuator including a housing which is separated into a first chamber and a second chamber by a deformable diaphragm, the capillary tube containing the dilatable fluid being connected to the first chamber, the second chamber having a return spring operatively associated with the diaphragm and a plunger affixed to the diaphragm and having an external end positioned outside of the housing of the actuator, the means for maintaining the temperature of the heating assembly at a predetermined level or range further including a linkage device positioned between the plunger and the valve for regulating the feeding of the fuel.

Still further according to the present invention, the valve includes a control arm extending therefrom for controlling the opening and closing of the valve, the control arm being spring biased towards an open position of the valve, wherein the means for maintaining the temperature of the heating assembly at a predetermined level or range further includes a two-armed pivotably mounted lever, wherein the external end of the plunger is in contact with a first arm of the lever and the control arm is in contact with a second arm of the lever.

Still further according to the present invention, the means for maintaining the temperature of the heating assembly at a predetermined level or range includes a first plunger arm and a second plunger arm extending from the plunger outside of the housing of the actuator, wherein the first plunger arm, in a closed fuel position, is adapted to maintain immobilized, between the first plunger arm the housing of the actuator, a generally horizontal wing of a control member, the control member further including a generally vertical wing extending upwardly and which is bored with an opening through which extends a first arm of a lever journalled about a generally horizontal axis, a second arm of the lever extending above the external end of the plunger, the first lever arm being connected to a generally vertical control slide valve which is biased upwardly by a return spring and which can be positioned on a seat, positioned beneath it, which constitutes the orifice of a fuel supply conduit and which is interposed on the fuel flow path from the supply conduit as far as the catalytic burner, and the means for maintaining the temperature of the heating assembly at a predetermined level or range further includes a cam which is pivotably mounted and spring-biased to a rest position, the cam being adapted to control the opening the valve, the cam being positioned beneath the second plunger arm and extending beyond the housing of the actuator for lifting the second plunger arm and, consequently, the plunger, by manual rotation of the cam.

According to another embodiment of the present invention, the means for maintaining the temperature of the heating assembly at a predetermined level or range includes a bimetallic strip which is fixed at a lower end and which is inclined on one side with respect to the vertical, while being in contact, in a stop position of the valve, with a closed maintenance arm solidly affixed to a first end of a generally horizontal lower control rod, a manually manipulable cam which is positioned in the immediate proximity of the upper portion of the bimetallic strip, thereby being adapted to straighten the bimetallic strip into a generally rectilinear vertical position, the generally horizontal lower control rod being slidably mounted generally horizontally, and a second end of the control rod being journalled at the end of the lower arm of a lever which is journalled about a generally horizontal axis and whose upper arm is connected, at a point in its length, to an upper control rod slidably mounted generally horizontally, facing the upper portion of the bimetallic strip, the upper arm of the lever being coupled to a piston slidably mounted generally horizontally in a bore formed in a valve member and into which opens a lateral conduit connected to the catalytic burner, the piston being constantly biased towards the exterior by a return spring, and supporting, on a front internal surface, a joint for sealing a seat of the valve provided at the point of the orifice of a fuel supply conduit provided in the valve body, coaxially with the piston.

According to a further aspect of the invention, the shoe or boot includes means for visually verifying the operation of the burner including an indicator device positioned on the shoe or boot.

In one embodiment of this aspect of the invention, the means for visually verifying the operation of the burner includes an optical sensor which is positioned proximate the burner and an optical fiber connecting the optical sensor to the indicator device.

According to another embodiment of this aspect of the invention, the means for visually verifying the operation of the burner includes, in the immediate proximity of the burner, a bulb which is connected, by a capillary tube, to the indicator device, the bulb and the capillary tube containing a dilatable fluid, wherein the fluid is adapted to dilate when the temperature of the burner is raised, causing the displacement of a movable index in front of a window of the indicator device.

According to a further embodiment of this aspect of the invention, the means for visually verifying the operation of the burner includes a bimetallic strip extending in close proximity to the burner so as to be able to be heated by the burner, the bimetallic strip engaging one end of an arm of a two-armed lever which is journalled about an axis and whose second arm is connected to one end of a flexible cable which is slidably contained within a sheath, the cable extending to the indicator device, wherein the indicator device includes a housing having a window within which a movable indicator moves and wherein another end of the cable is attached to the movable indicator for moving the movable indicator.

BRIEF DESCRIPTION OF THE DRAWINGS

Preferred embodiments of the present invention are described below, by way of non-limiting examples, in which further objects, features, and advantages of the present invention will become apparent, with reference to the annexed drawings in which.

DETAILED DESCRIPTION OF THE PREFERRED EMBODIMENTS

Figure 1:
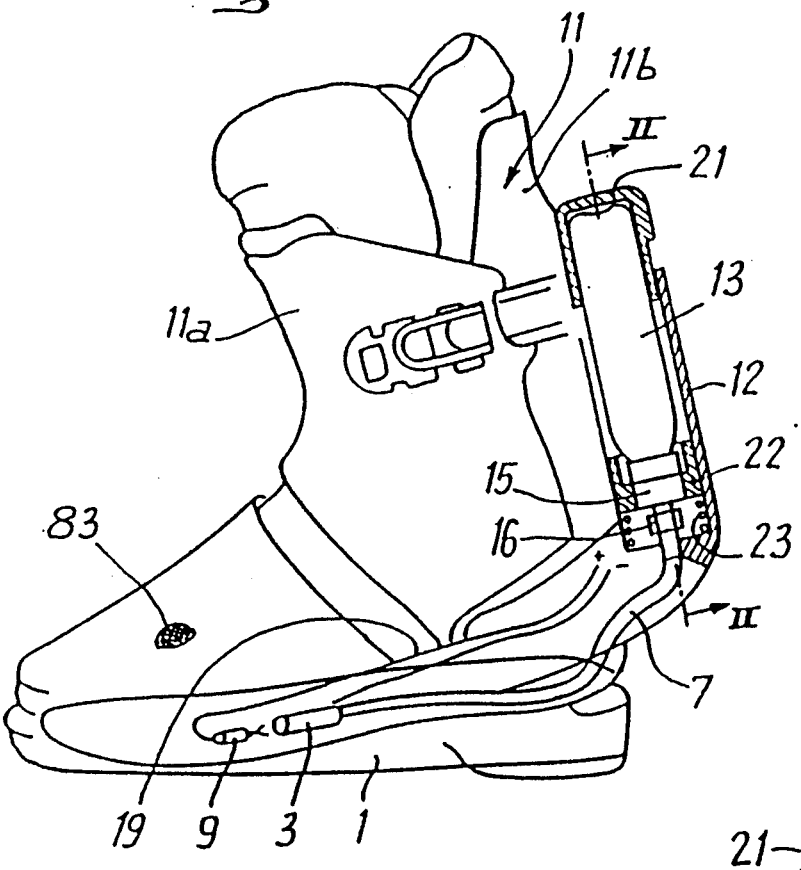
FIG. 1 is an elevated schematic view, in partial section, of a downhill ski shoe or boot provided with a heating device according to the invention.

As mentioned above, an object of the present invention is to remedy the disadvantages of the above-mentioned known devices by providing a shoe or boot which includes a heating device of a particularly simple design, which has a high energy efficiency, with long duration of service and a particularly convenient use.

To that end, the shoe or boot of the present invention, which is preferably intended for a downhill or cross-country ski, is provided with a heating device which comprises a heating assembly positioned within the sole of the shoe or boot. The heating assembly includes a catalytic burner and a heat diffusion plate located in the support zone of the foot of the wearer of the shoe or boot. Further, a source of gas fuel is connected to the catalytic burner by means of a suitable valve, and a heating control device is utilized to maintain a certain temperature level or temperature range. By means of the present invention, the gas fuel source is constituted by an interchangeable fuel cartridge and means are provided on the upper, or the vamp, of the shoe or boot to receive and maintain the interchangeable gas cartridge in position and connect it to the supply circuit of the catalytic burner.

The downhill ski boot which is shown schematically in FIGS. 1–4, comprises in its sole 1, a heating assembly 2 which is constituted essentially by a catalytic burner 3 connected to a heat diffusion plate 4. The heating assembly 2 is positioned in an opening of an appropriate shape which is provided in the upper part of the sole 1 of the boot, this opening being shaped so that the heat diffusion plate 4, which constitutes the upper part of the heating assembly 2, extends over the greatest part of the support zone of the foot. The burner 3 is affixed to the diffusing plate 4 by any appropriate means, particularly by welding, and it is solidly affixed to the lower surface of the plate 4, i.e., that which is opposite that in contact with the internal sole 5 which is to be heated. The catalytic burner 3 can be of any known type ensuring the combustion of a gas by catalysis. The burner 3 is connected to a gas supply tube 7. To the burner 3 is attached an electrode 9 which is part of an ignition device of the piezoelectric type, for example.

Furthermore, the upper 11 of the shoe or boot, which can be made of one or several parts, supports, on its rear wall, a housing 12 adapted to receive and maintain an interchangeable gas cartridge 13. In this non-limiting embodiment, the ski boot is of the rear-entry type and its upper is constituted by two parts, namely a front cuff **11*a* and a rear spoiler 11*b* journalled at the lower part, around a horizontal and transverse axis. The receiver housing 12 for the gas cartridge 13 is provided on the rear surface of the rear spoiler 11*b* and it is preferably molded with the latter, if it is made of a plastic molded material. The receiver housing 12 is preferably made in the form of a prismatic or cylindrical housing open at its upper end and in which the cartridge 13 can be engaged from top to bottom, with its gas outlet orifice directed downwardly. Positioned beneath housing 12 is an assembly 15 which includes a control valve to which is connected a device 16** for the entry of ambient air, further discussed below, to form an appropriate gas-air mixture downstream for combustion.

The heating device likewise comprises an ignition device which comprises, for example, a piezoelectric igniter 17 energized by action on a pusher 18 and which is connected by a conductor 19 to the electrode 9 so as to produce an ignition spark by means of this electrode.

Figure 2:
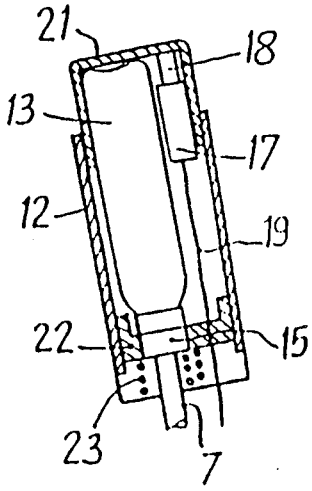
FIG. 2 is a sectional view along line II—II of FIG. 1.
Figure 3:
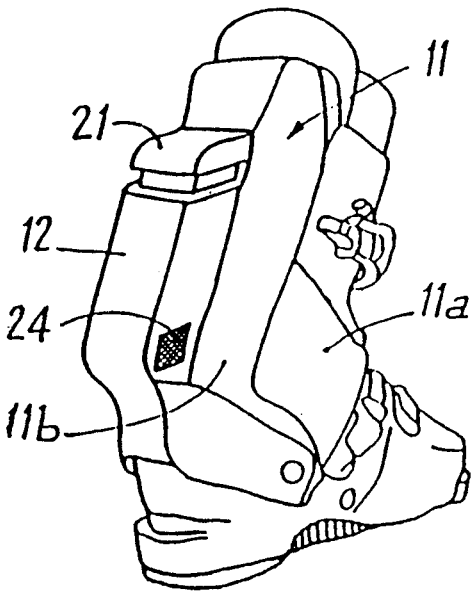
FIG. 3 is a perspective view, taken from the rear of a downhill ski boot of the rear entry type.
Figure 4:
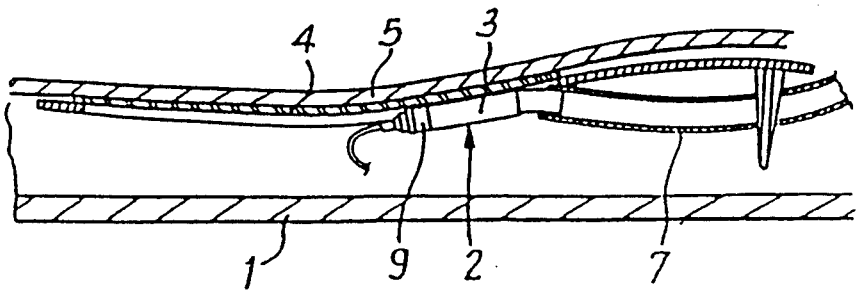
FIG. 4 is a vertical and longitudinal sectional view of the heating assembly positioned in the sole of a shoe or boot according to the invention.

Preferably, the external upper end of the gas cartridge 13 is positioned in a movable cover 21 which is slidably engaged in the upper part of housing 12. As can be seen in FIG. 2, cover 21 rests, on the one hand, on the upper end of the gas cartridge 13 and, on the other hand, on the pusher 18 of the piezoelectric igniter 17.

The lower or internal end of the gas cartridge 13 rests on a piston 22 slidably mounted in the housing 12 and which is elastically biased towards the top by a compression spring 23 positioned between the piston 22 and bottom of housing 12. The piston 22 supports, in its central part, the control valve 15 whose outlet is connected to the air pipe 16. The air pipe 16 is preferably constituted by a venturi toward the axis of which is injected the gaseous mixture leaving the valve 15, so as to cause the suctioning of air, by induction, from the exterior. The venturi constituting the air pipe 16 is connected to tube 7 which is flexible, at least in part, so as to be able to follow the angular range movement of the rear spoiler **11*b* during the opening and closing movement thereof. The space in which the air pipe 16 is positioned communicates with the exterior by means of one or several openings 24 provided in the wall of housing 12 containing the cartridge 13. Extending across each opening for air entry 24** is a filtering element made of any material permeable to air but impermeable to foreign matter coming from the environment, particularly snow.

According to the preceding description, it can be seen that the starting of the heating device according to the invention is particularly simple. To do so, the wearer of the shoe or boot first opens the control valve 15, by means of a movable control arm extending therefrom and which is accessible to the wearer at the rear of the boot by placing it in a starting position in which a strong output of gas fuel and air mixture is furnished by the tube 7 to burner 3. Then the wearer of the shoe or boot presses the cover 21 so as to push the gas cartridge 13 in the direction of the bottom of housing 12 against spring 23. This movement results in the pressing of the pusher 18 and, consequently, the emission, by the piezoelectric igniter 17, of an electric impulse transmitted to the electrode 9, which then produces a spark. This spark causes the ignition of the combustible gas in the catalytic burner 3 and the formation of a flame. Because of the characteristics particular to the operation of the catalytic burner 3, which is known per se, the flame then disappears and the burner 3 is brought to a high temperature because of the catalytic combustion of the gas-air mixture which is furnished to it by the tube 7. The heat produced by the burner 3 is transmitted and distributed by the heat diffusion plate 4, so as to ensure the heating of the foot of the wearer of the shoe or boot.

Figure 5:
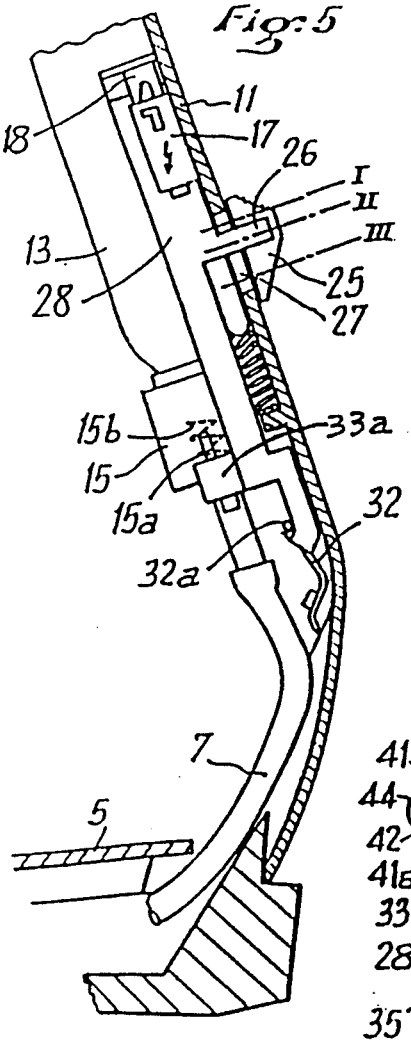
FIG. 5 is a vertical and longitudinal sectional view, on a larger scale, of an embodiment of the device for control of the heating device, in the open position of the gas supply valve.

In an alternative embodiment of the invention which is shown in FIG. 5, the interchangeable gas cartridge 13 is mounted within the rear wall of the upper 11 of the shoe or boot which, in this embodiment, is constituted by a single part. Beneath the cartridge 13 the pressure-reducing valve assembly 15 is mounted to which the tube 7 feeding the burner 3 of the heating assembly 2 is connected.

Figure 6:
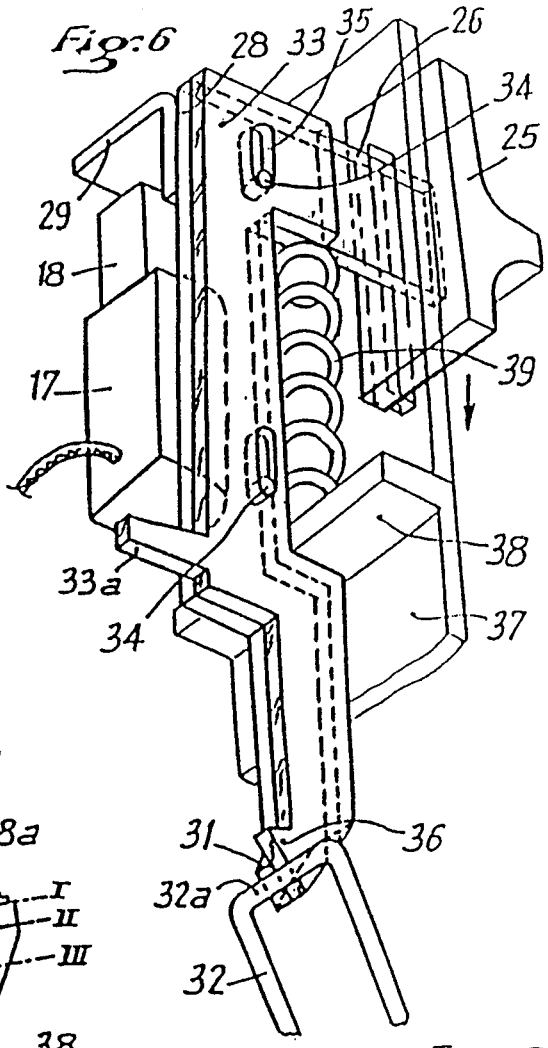
FIG. 6 is a perspective view of the control device of FIG. 5.

FIG. 6 is a perspective view of an alternative embodiment of the invention which is essentially the same as that shown in FIG. 5 and, for the purpose of the following description, reference can be made to either, except for slight differences which will become apparent as the description proceeds.

The device for control of the heating comprises a control knob 25 which can slide "vertically" outside of the rear wall of upper 11. In the description which follows, the direction of the rear wall of upper 11 will be described as being "vertical", whereas this wall can be, in fact, slightly inclined towards the front or in any other appropriate position. The control knob 25 is affixed to a lug 26 extending through a vertical slot 27 provided in the rear wall of the upper. The lug 26 constitutes the external extension of the upper horizontal wing of a manual release plate 28 in the general shape of a C open towards the rear, extending vertically. The manual release plate 28 supports, at its upper end, a member 29 in the shape of an angle iron which is affixed to the plate by a vertical wing and whose horizontal wing extends a short distance, in the gas cutoff position, which is shown in FIG. 6, above the upper pusher 18 of the piezoelectric igniter 17 affixed to upper 11. The lower horizontal wing of the manual release plate 28 is extended towards the bottom by a bar ending in a release ramp 31 which acts on the upper horizontal member 32*a* of a latching spring 32 in the shape of loop or inverted U. This latching spring 32 is affixed to the lower part of upper 11 or to the shell base of the shoe or boot.

Furthermore, the heating control device comprises a latching plate 33, best seen in FIG. 6, which is attached to the manual release plate 28 and which has a generally C shape open towards the rear. The two plates 28 and 33 are coupled to one another by means of guide pins 34 provided on the member of one of the plates, in this case on that of the manual release plate 28, which are engaged in slots 35 provided in the member of the other plate 33, these slots 35 being generally aligned and generally vertically elongated. The lower horizontal wing of the latching plate 33 is extended towards the bottom by a bar which ends, in a latching hook 36 adapted to be gripped under member 32*a* of the latching spring 32. The latching spring acts as a catch for the latching hook. Furthermore, the latching plate 33 supports, at its lower part, a projecting lug 33*a* which operates beneath a control arm 15*a*, shown extending from the valve 15 through a vertical slot 15*c* in the body of the valve 15, and which controls the opening and closing of valve 15. The control arm 15*a* is biased towards its lower opening position and against lug 33*a* by a spring 15*b* lodged in the body of the valve and schematically shown in dotted lines in FIG. 5.

In FIG. 5 form of the embodiment, the latching plate 33 is hidden by the manual release plate 28, as are the guide pins 34 and the slots 35. It can be seen that the lateral positions of the plates 28 and 33 in FIG. 5 are reversed from the lateral positions in FIG. 6. In FIG. 6, the cartridge 13, valve 15 and control arm 15*a* are not shown, for the purpose of more clearly illustrating other portions of the invention, but these elements would be positioned adjacent latching plate 33, toward the right side of FIG. 6. Also in FIG. 5, the manual release plate 28 is shown to extend upwardly more so than in FIG. 6, together with member 29 and igniter 17 which is actuated by member 29.

The two plates 28, 33 as well as the piezoelectric igniter 17, are preferably mounted on a support 37 affixed within upper 11 and which has a support shoulder 38 for a return spring 39. This return spring 39 is a compression spring resting, at its lower end, on shoulder 38 and, at its upper end, under both of the upper horizontal wings of plates 28 and 33. Spring 39 thus constantly biases the two plates 28, 33 towards the top and their movement in this direction is limited by the abutment of the lower wings of plates 28, 33 under the support shoulder 38.

The control knob 25 can occupy, in the slot 27, three different vertical positions, namely, an extreme upper position I, corresponding to the cut-off of the gas supply, an intermediate position II, corresponding to the opening of the gas supply, and an extreme lower position III, corresponding to the activation of the piezoelectric igniter 17, these three positions I, II, III being indicated in chain-dotted lines in FIG. 5. In the upper cut-off position I, the different elements of the heating control device are in the position illustrated in FIG. 6. In this case the two plates 28, 33 are in the extreme upper position by being pushed in this position by the return spring 39, their upward movement being limited by the abutment of their lower wings against the support shoulder 38. In this position the horizontal wing of the angle iron 29 is positioned a short distance above the pusher 18 of the piezoelectric igniter 17. Furthermore, the release ramp 31 and the latching hook 36 are positioned a small amount above the upper horizontal member 32*a* of the latching spring 32.

When the skier wants to start up the heating device, he or she engages the control knob 25 so as to displace it downwardly. In this movement the control knob 25 moves with it the manual release plate 28, to which it is solidly affixed, and the latter immediately moves in turn the latching plate 33, since the guidance pins 34 which are solidly affixed to the plate 28, are in contact with the lower ends of slots 35 provided in plate 33. The two plates 28, 33 are thus jointly displaced towards the bottom, against the biasing action of the return spring 39. In the course of this movement, the latching hook 36 slides along the member 32*a* of spring 32 while pushing it somewhat, after which it is placed under this member to ensure the latching. The release ramp 31 naturally accompanies this movement. At the same time the lug 33*a* of the plate 33 frees the control arm 15*a* of valve 15 so that this valve opens. Consequently, as soon as the control knob 25 reaches the intermediate position II, the valve 15 is open and the gas contained in the interchangeable cartridge 13 can then flow through the tube 7 in the direction of the burner of the heating assembly.

To cause the ignition of the gas-air mixture, the skier presses down on the control knob 25 so as to bring it into its extreme lower position III. In the course of this additional downward movement, the horizontal wing of the angle iron 29 which then was, in the intermediate position II, just in contact with the upper end of pusher 18, pushes the pusher 18 downwardly and causes the activation of the piezoelectric igniter 17 which emits an electrical impulse leading to a spark of ignition produced by the electrode 9. In the course of this additional downward displacement, the release ramp 31 and the hook 36 are displaced beneath the member 32*a* of spring 32. During the releasing of the control knob 25, after ignition of the gas, the two plates 28, 33 are pushed upwardly by spring 39 until the hook 36 becomes engaged beneath member 32*a* of spring 32. From this moment the two plates 28, 33 are immobilized in the intermediate open position II as is shown in FIG. 5. In this position the lug 33*a* of the latching plate 33 is situated just below the control arm 15*a* of the valve 15 which is itself in its extreme lower open position in a slot of the body of the valve.

When the skier wishes to stop the heating, he or she pulls the control knob 25 upwardly to bring it back into its extreme upper cut-off position I. In the course of this cut-off phase, the control knob 25 first causes the upward sliding of the single manual release plate 28, because of the coupling achieved by the guidance pins 34 and the slots 35, these pins 34 then moving upwardly alone in the slots 35, latching plate 33 remaining immovable. Consequently, only the manual release plate 28 is displaced upwardly and its lower release ramp 31, which slides into contact with upper member 32*a* of spring 32, pushes progressively towards the interior this member by progressively thus separating the spring until the release hook 36 can escape from it. The slope of the release ramp 31 and its length are selected such that the escaping of the latching hook 36 occurs before the guidance pins 34 reach the upper ends of slots 35. When the latching hook 36 escapes spring 32, the plate 33 is freed and the two plates 28, 33 are pushed jointly upwardly, in the cut-off position, by the spring 39. In this movement the lug 33*a* of the plate 33 moves the control arm 15*a* of valve 15 upwardly with it, until the latter is placed in the closed position, at the upper end of its guidance slot.

Figure 7:
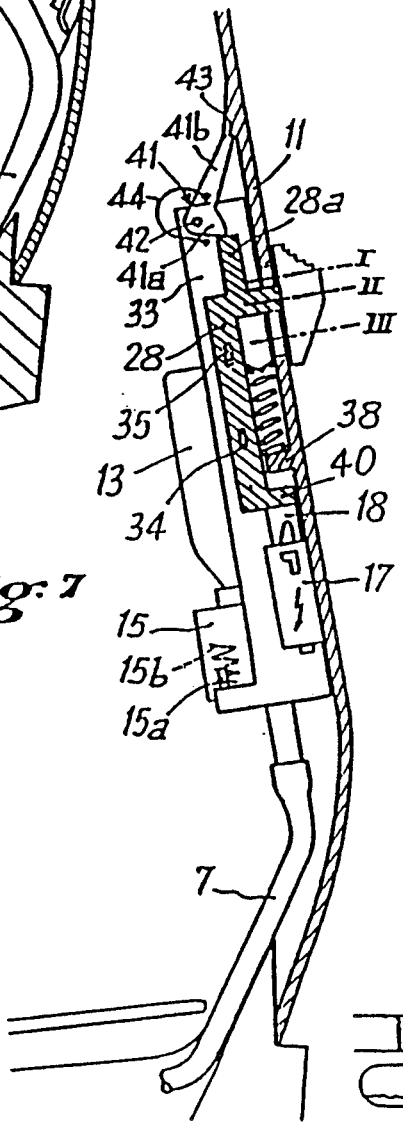
FIG. 7 is a vertical and longitudinal sectional view of an alternative embodiment of the heating control device.

In the alternative embodiment of the invention which is shown in FIG. 7, the heating control device likewise comprises the two vertical plates 28, 33 attached to each other by means of guide pins 34 positioned in the elongated slots 35. In this case, the lower horizontal wing 40 of the manual release plate 28 which extends underneath the support shoulder 38, is placed just above the upper pusher 18 of the piezoelectric igniter 17 which is affixed to the lower part of upper 11, beneath the support shoulder 38. Furthermore, the latching plate 33 supports, at its extreme upper part, a latching catch 41 which is pivotably mounted on the plate 33, around a horizontal and transverse axis 42. This catch 41 comprises two arms, namely, a short lower arm 41*a* with which the upper end of a vertical lug 28*a* is in contact, extending the release plate 28 upwardly. The catch 41 also comprises an upper arm 41*b* which is longer and extends upwardly and which can be engaged under a tooth 43 provided on the internal surface of the rear wall of the upper 11. The catch 41 is biased elastically in a clockwise direction, by means of a spring 44 which is hooked, respectively, at its two ends, to the plate 33 and to the catch 41 such that the upper arm 41*b* of the catch 41 is pressed constantly against the rear wall of upper 11 of the shoe or boot.

In the gas cut-off position, the control knob 25, as well as the two plates 28, 33, are in the extreme upper position I and the catch 41 is retracted, its upper arm 41*b* extending freely above the latching tooth 43. Furthermore, the lower wing 40 of the release plate 28 is positioned just beneath the shoulder 38 with which it is in contact, while being thus at a distance from the pusher 18 of the piezoelectric igniter 17.

When the skier wants to start up the heating device, he or she engages the control knob 25 to move it into the intermediate open position II which is that shown in FIG. 7. In the course of its downward movement, the manual release plate 28, which is moved directly by the control knob 25, moves the release plate 33 with it and, consequently, the catch 41 supported thereby. At a certain time the end of the upper arm 41*b* of the catch 41 passes beneath the tooth 43 and then the catch rotates in a clockwise direction around the pivoting axis 42, under the action of the return spring 44. From this moment, the catch 41 is engaged under the tooth 43 and it opposes any upward movement of the plate 33. By continuing to move the control knob 25, the manual release plate 28 descends even more and then acts, by its lower wing 40, on the pusher 18, and pushes the latter and causes the emission of the electrical impulse generating the spark of ignition. In the course of this additional downward movement, the plate 33 follows the plate 28, as in the previously described case. When the skier releases the control knob 25, the two plates rise under the action of the return spring 39 and this rising movement is limited by the abutment of the end of the upper arm 41*b* of catch 41, which slides against the interior surface of upper 11, with the latching tooth 43. The two plates 28, 33 are then immobilized in the intermediate open position II which is shown in FIG. 7.

If the skier wants to shut off the heating of the shoe or boot, he or she pulls upwardly on the control knob 25 to bring it into the extreme upper position I. The upward force exerted on the control knob 25 is transmitted to the plate 28 and the lug 28*a* thereof then acts on the small lower arm 41*a* of catch 41, so as to make the catch pivot in a counterclockwise direction. Following this movement, the upper arm 41*b* of the catch escapes the tooth 43 and the two plates 28, 33 can then rise into the extreme upper position I under the action of return spring 39.

The heating device of the shoe or boot according to the invention can be preferably provided with a device for automatic temperature adjustment. Non-limiting embodiments of such a device for temperature adjustment are illustrated in FIGS. 8, 9, and 10.

Figure 8:
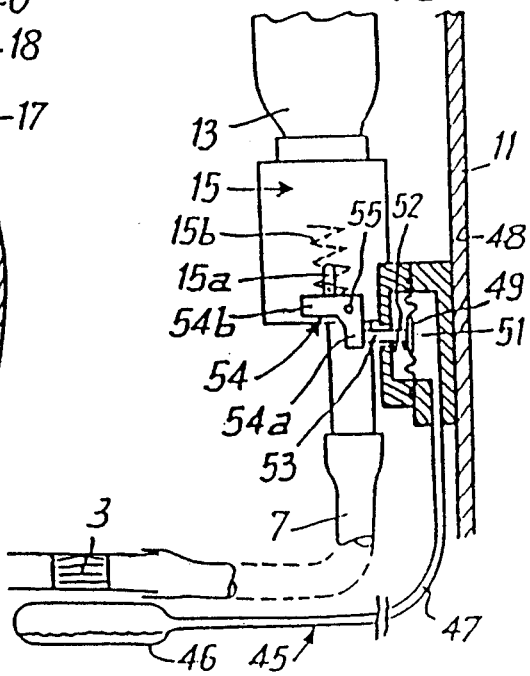
FIG. 8 is a schematic view of an embodiment of a device for regulation of the temperature by control of the turning on of the gas.

The device for temperature adjustment shown in FIG. 8 comprises a closed circuit 45 filled with a dilatable fluid. This closed circuit 45 comprises, at one end, a bulb 46 positioned near the heat source constituted in this case by the catalytic burner 3, an intermediate capillary tube 47, and at its other end, a diaphragm actuator 48. This actuator is affixed to the internal surface of the rear wall of the upper 11, near arm 15*a* for controlling the opening and closing of the gas supply valve 15. The actuator 48 comprises a housing in which a chamber is provided which is separated into two parts by a deformable diaphragm 49. The tube 47 containing the dilatable fluid is connected to a working chamber 51 defined by the deformable diaphragm 49 and the bottom of the housing. In the other chamber a return spring 52 is positioned for diaphragm 49. On this side the diaphragm 49 is likewise extended by a plunger 53 affixed to the center of the diaphragm and extending outside of the housing of the actuator 48. At its external end, the plunger 53 is in contact with a lower arm 54*a*, extending downwardly, of a lever 54 in the form of an angle iron which is journalled about a horizontal transverse axis 55. Furthermore, this lever 54 comprises a horizontal arm 54*b* extending in the direction of the interior of the shoe or boot and which is in contact under the arm 15*a* for controlling the opening and closing the valve 15, which is constantly biased downwardly by the return spring 15*b* incorporated into the member of valve 15.

According to the preceding description, it can be seen that when the temperature of the bulb 46 and, consequently, that of the fluid contained within the closed circuit 45, reach a predetermined threshold value the dilatation of the fluid within the closed circuit 45 causes an expansion of the volume of the working chamber 51 and the displacement of the diaphragm 49 towards the left in FIG. 8. Because of this displacement, the pusher 53 makes the lever 54 pivot in a clockwise direction so that the upper horizontal arm 54*b* of this lever 54 pushes the control arm 15*a* upwardly, causing the closure of the valve 15 and the shutting off of the gas supply of burner 3. When the temperature goes down again, the volume of the fluid contained within the closed circuit 45 and, particularly, that within the bulb 46 contracts, the diaphragm 49 and the pusher 53 move towards the right and the return spring 15*b* makes the control arm 15*a* of valve 15 return to the lower open position. The burner 3 is then fed again with gas and the catalytic combustion can resume, the residual heat of the plate being sufficient to retrigger said combustion.

Figure 9:
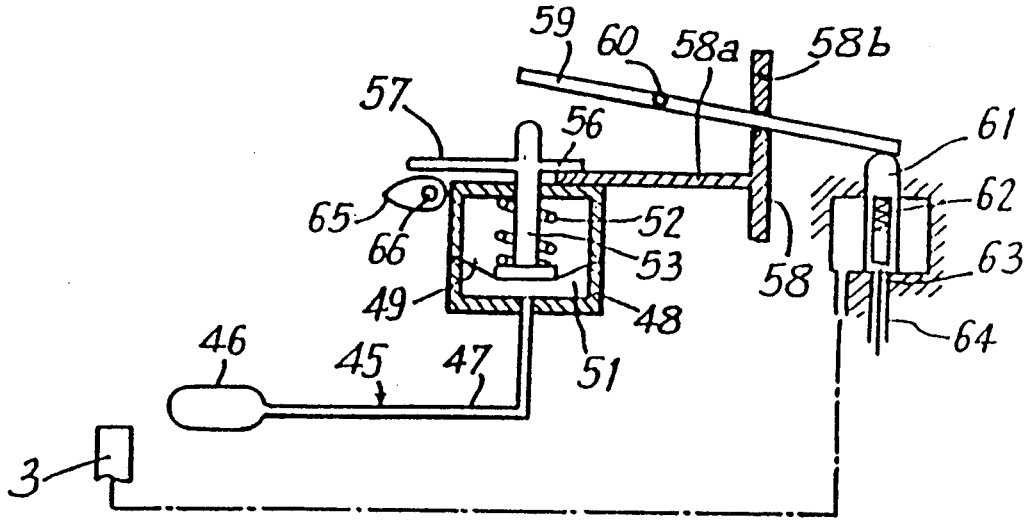
FIG. 9, 9A, and 9B are schematic views of an alternative embodiment of a device for temperature regulation, during different operational phases.
Figure 9A:
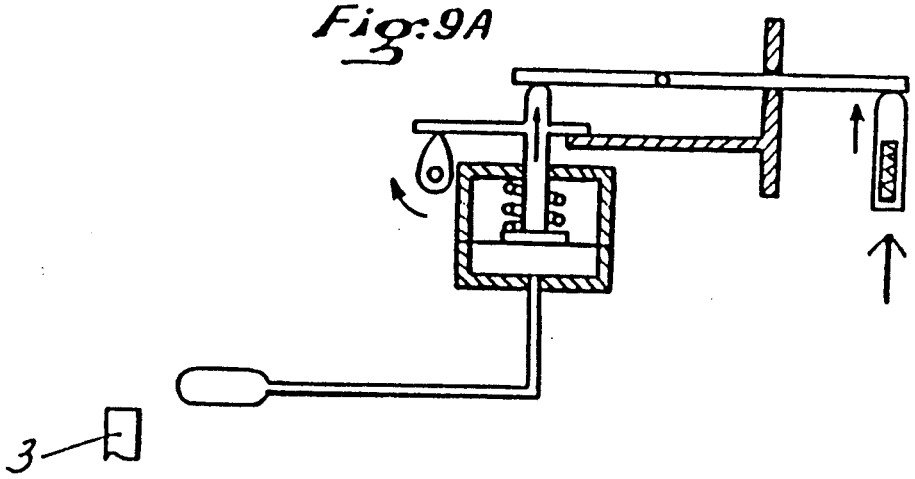
Figure 9B:
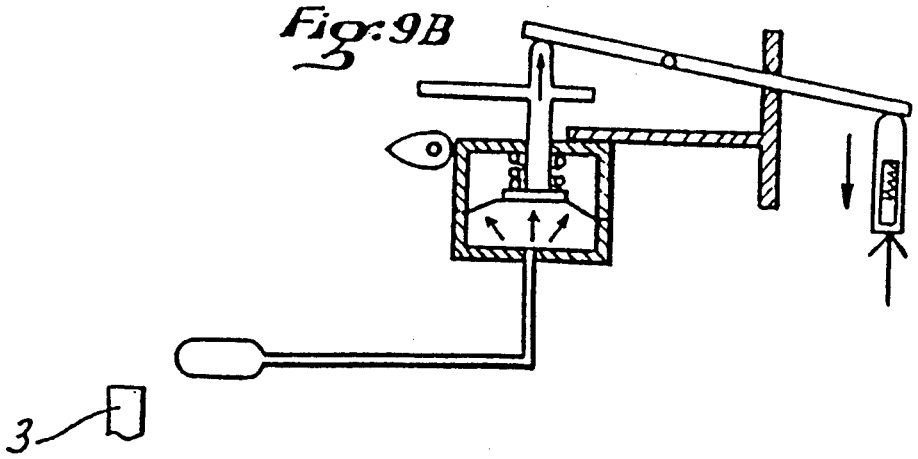
Figure 10:
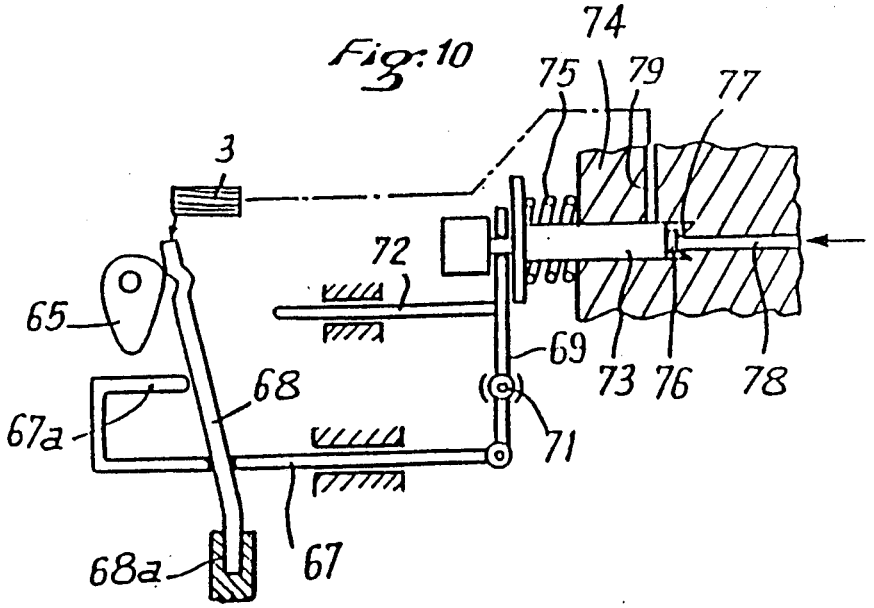
FIGS. 10, 10A, and 10B are schematic views of another alternative embodiment of a device for temperature regulation, during different operational, phases.

In the alternative embodiment of the invention shown in FIGS. 9, 9A, and 9B the plunger 53 of the diaphragm actuator 48 supports, outside of the housing of this actuator, two radial control arms 56, 57 which are diametrically opposed. In the stop or cut-off position which is shown in FIG. 9, the control arm 56 maintains immobilized, between control arm 56 and the wall of the actuator housing 48, a horizontal wing 58*a* of a control member 58 comprising a vertical wing 58*b* which extends upwardly. This vertical wing 58*b* is bored with an opening through which extends the right arm of a lever 59 journalled about a horizontal axis 60 which is shown to be perpendicular to the plane of FIG. 9. The left arm of the lever 59 extends above the external end of the plunger 53, at a distance therefrom. The end of the right arm of lever 59 is connected to a vertical control slide valve 61 which is biased upwardly by a return spring 62 and which can be applied to a seat 63 positioned beneath it, which constitutes the orifice of a gas supply conduit 64. The seat 63 is interposed on the flow path of gas from the supply conduit 64 extending to burner 3. Furthermore, the regulation device shown in FIG. 9 comprises a cam 65 to control the turning on of the gas, returned to the horizontal position by a return spring not shown, which is mounted rotating about an axis 66, below the radial control arm 57 of the plunger 53, extending beyond the housing of the actuator 48, so as to be able to lift this control arm 57 and, consequently, the plunger 53 by manual rotation of the cam 65 in the vertical position.

In the stop position, as is shown in FIG. 9, no pressure is created in the lower working chamber 51, beneath diaphragm 49, because the bulb 46 is not heated by the burner 3 which is then extinguished. The diaphragm 49 is then pushed downwardly by spring 52 and the plunger 53 is pulled to the maximum within the housing of actuator 48. In this position the plunger 53 maintains the horizontal wing 58*a* of the control member 58 firmly between its left control arm 56 and the wall of the housing of actuator 48. The opening provided in the vertical wing 58*b* of the member 58 is beneath the pivoting axis 60 so that the lever 59 is inclined from top to bottom and from the left to the right. In this position the control slide valve 61 is pressed against the seat 63 so that the gas supply of the burner is interrupted. In this stop position the cam 65 is extended in the horizontal direction just underneath the left arm 57 of plunger 53.

When the skier wants to start up the heating device, he or she must turn the control cam 65, by means of a suitable control knob, e.g., in a clockwise direction about axis 66, to bring it to the vertical position as is shown in FIG. 9A. In the course of this rotational movement, the cam 65 pushes the left control arm 57 upwardly, which causes the lifting of the plunger 53 to the outside of the housing of actuator 48. In the course of this movement, the right control arm 56 of the plunger 53 releases the horizontal wing 58*a* of the member 58 so that the member 58 can likewise move upwardly, under the action of the return spring 62 which pushes the control slide valve 61 upwardly and pivots control lever 59 in a counterclockwise direction about the pivoting axis 60. The control slide valve 61 then separates from the seat 63 so that the gas can flow through this seat and can arrive at burner 3 where it is ignited by means of the piezoelectric igniting device as was indicated previously. In the moderate heating position which is illustrated in FIG. 9A, the diaphragm 49 extends horizontally, the same as control lever 59 which then rests by its left arm against the upper end of pusher 53.

From this moment, the adjustment device intervenes to cut off the gas supply when the temperature goes beyond a value of a predetermined threshold. In this case, the dilatation of the gas contained in the closed circuit 45 is such that the pressure produced in the lower working chamber 51 causes an upward deformation of the diaphragm 49 as is shown in FIG. 9B. The pusher 53 is then preferably pushed towards the outside, against the return spring 52 and this vertical movement towards the top of the pusher 53 causes a pivoting of the control lever 59 in a clockwise direction about axis 60. The right arm of this lever 59 then goes down while making the control member 58 go down again on the one hand, the horizontal wing 58*a* again resting against the upper wall of the housing of the actuator 48, and on the other hand the control slide valve 61 then closing the seat 63. At this moment the gas supply of the burner 3 is cut off.

When the temperature goes below the threshold value, the spring 52 pushes the diaphragm 49 and the pusher 53 towards the bottom, the lever 59 is then freed and the return spring 62 pushes the slide valve 61 towards the top, by opening the seat 63, to re-establish the gas supply of burner 3.

Figure 10A:
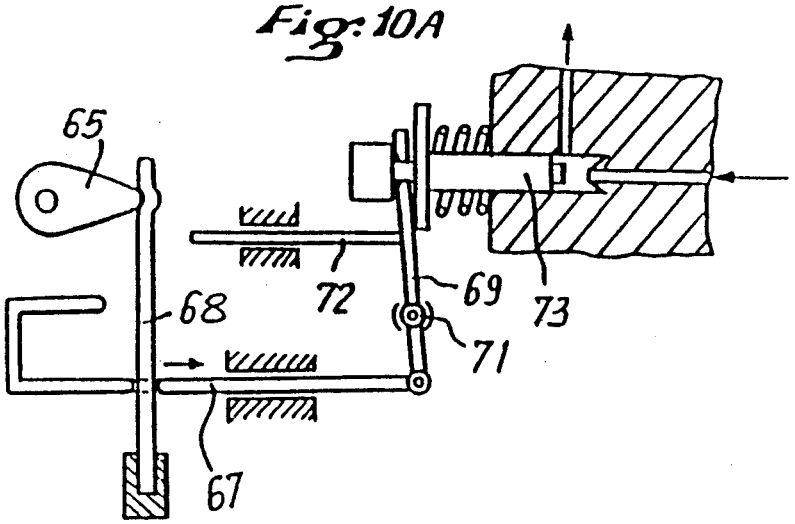
Figure 10B:
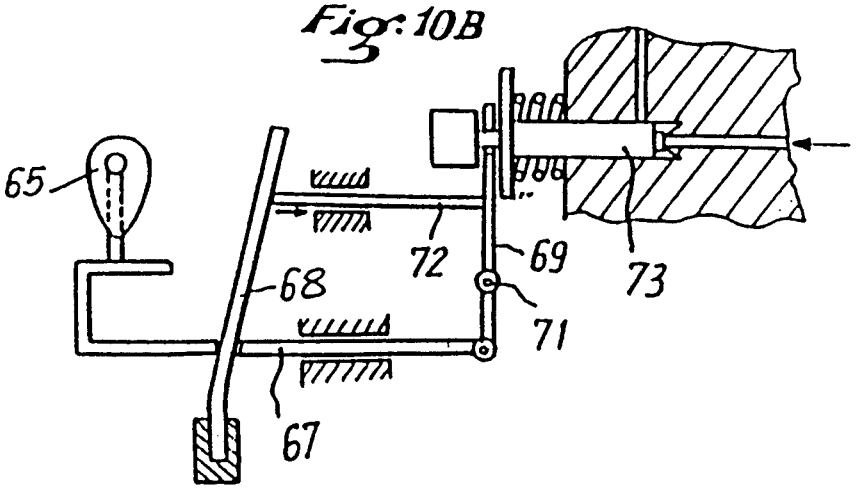

In FIGS. 10, 10A, and 10B an alternative embodiment of the adjustment device is shown. In this embodiment, a bimetallic strip 68 is used which is anchored to its lower fixed end 68*a* and which is inclined on one side with respect to the vertical, i.e., towards the left in the drawing, while being in contact, in the stop position shown in FIG. 10, with a closed maintenance arm 67*a* solidly affixed to the left end of a horizontal control rod 67. Furthermore, an activation cam 65, which is manually manipulable, is positioned in close proximity to the upper part of the bimetallic strip so as to straighten the latter into a generally vertical rectilinear position. The lower control rod 67 is mounted to slide generally horizontally and its right end is journalled at the end of the lower arm of a lever 69 journalled about a generally horizontal axis 71 shown perpendicular to the plane of the figure. The upper arm of the lever 69 is connected, at one point of its length, to an upper control rod 72 mounted to slide horizontally. The upper arm of lever 69 is coupled, at its upper end to a piston 73 mounted to slide horizontally in a bore formed in the body of the fuel valve 74. This piston 73 is biased constantly towards the exterior by a return spring 75. The piston 73 supports, on its internal frontal surface, a joint 76 able to seal the seat of valve 77 provided at the point of the orifice of a gas supply conduit 78 provided in the member 74, coaxially with the piston 73. A lateral conduit 79 connected to burner 3 opens into the bore in which the piston 73 slides.

In the stop position, as is shown in FIG. 10, the bimetallic strip 68 is inclined towards the left while being in contact with control arm 67*a*, which is thus pulled towards the left. Consequently, lever 69 holds the piston 73 against the return spring 75 in its extreme right position in which it applies the joint 76 onto seat 77, while thus sealing the passage of the gas in the direction of the burner 3 which is not supplied, as a result.

When the skier wishes to start up the heating device, he or she manually turns the cam 65 by 90° so as to bring it into the horizontal position shown in FIG. 10A. The cam 65 is turned in the horizontal position just during the period of time necessary to ignite it, after which it is brought back into the vertical rest position by an appropriate return spring which is not shown but which could comprise, e.g., a coil spring surrounding the pivot axis 66. In the horizontal position, the cam 65 pushes the bimetallic strip 68 with respect to its rest position, to bring it into a vertical rectilinear position. The bimetallic strip 68 then frees the maintenance arm 67*a*, and consequently the lower control rod 67 and lever 69. This translates into a pivoting of lever 69, under the action of the spring 75, in the counterclockwise direction so that its upper arm moves towards the left. As a result, the piston 73 is pulled towards the exterior, its joint 76 separates from seat 77 and a communication is established between the gas supply conduit 78 and the conduit 79 connected to burner 3. This burner is then fed with gas which is ignited by means of the piezoelectric igniter as described previously.

FIG. 10B illustrates the automatic operation of the temperature adjustment device. In the course of heating by burner 3, the bimetallic strip 68 deforms progressively and inclines more and more towards the right. When the temperature reaches the value of a predetermined threshold, the deformation of the bimetallic strip 68 is sufficient so that the latter pushes, by its upper part, the upper control rod 72 towards the right. This rod then causes a pivoting of lever 69 in the clockwise direction, so that the piston 73 is pushed towards the right in the bore of body 74 until its joint 76 seals the seat 77. From this moment the gas supply is cut off and the heating within burner 3 is extinguished.

When the temperature goes down, the bimetallic strip 68 deforms in the direction of its vertical position, thus freeing the control rod 72 and the piston 73 is then pushed towards the exterior, under the action of return spring 75, and thus reestablishing the communication between the conduits 78 and 79 and the gas supply of burner 3.

The temperature adjustment device, which is described above with reference to FIGS. 10, 10A, and 10B, has the advantage of ensuring an automatic cutting off of the gas supply in case combustion stops. In effect, if the burner 3 is extinguished, the bimetallic strip 5 is cooled and deforms to return to occupy its rest position illustrated in FIG. 10. This is made possible by the fact that the cam 65 is moved into the horizontal position solely to cause the initial opening of the gas supply circuit and that it then returns to the vertical position, as is shown in FIG. 10B. In the course of the return movement of bimetallic strip 68 to the rest position, the latter comes at a certain moment into contact with the maintenance arm 67*a* and it then moves arm 67*a* and the lower control rod 67 towards the left. This then causes a pivoting of the lever 69 in the clockwise direction and consequently the closing of the seat of valve 77 by piston 73.

There will now be described, be referring to FIGS. 11–14, various embodiments which provide a visual indication to verify the operation of burner 3.

Figure 11:
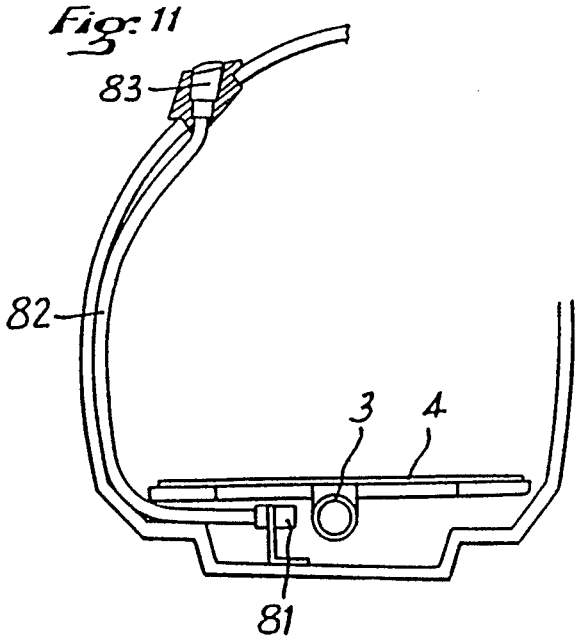
FIGS. 11, 12, and 13 are vertical and transverse sectional views illustrating various devices for visualization of the operation of the burner.

The embodiment shown in FIG. 11 comprises an optical sensor 81 which is positioned next to burner 3, and which is connected, by an optical fiber 82, to a point of observation 83 which is provided in the top of the front part of the shell base of the shoe or boot as is shown in FIG. 1 and 11 and which constitutes a luminous point due to the incandescence of the gas at the point of the burner. The skier can thus easily verify that the burner 3 is really working.

Figure 12:
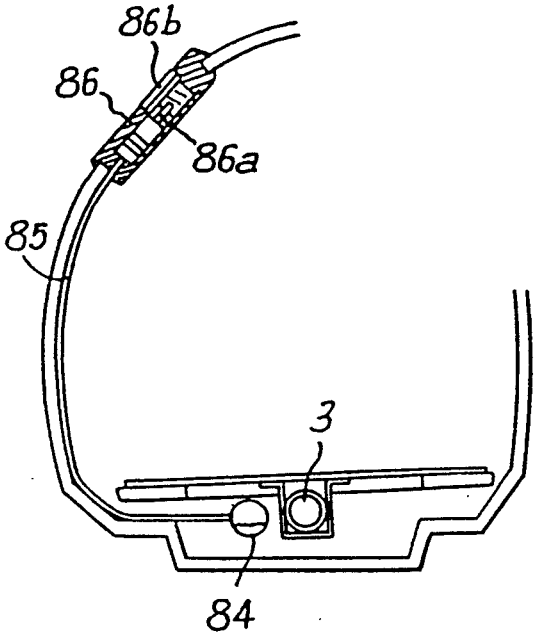

In the alternative embodiment of the invention which is shown in FIG. 12, the visual indication device comprises, in close proximity to burner 3, a bulb 84 which is connected, by a capillary tube 85, to an indicator device 86 provided on the front and upper part of the shell base. The bulb 84 and the capillary tube 85 contain a dilatable fluid and the dilatation of this fluid, when the temperature of burner 3 is elevated, causes the displacement of a movable indicator 86*a* before a window 86*b* of the indicator device 86.

Figure 13:
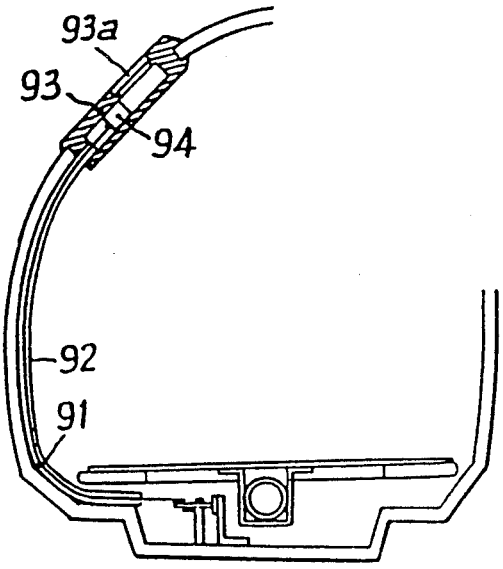
Figure 14:
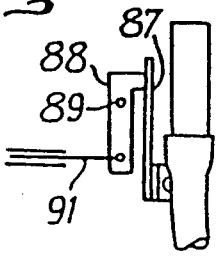
FIG. 14 is a plan view of the control system using a bimetallic strip in the embodiment illustrated in FIG. 13.

In the alternative embodiment of the invention which is shown in FIGS. 13 and 14, the visual indication device comprises a bimetallic strip 87 extending near the burner 3 so as to be heated by the latter. This bimetallic strip rests on one end of an arm of a two-armed lever 88 journalled about an axis 89 and whose other arm is connected to one end of flexible cable 91. This cable can slide in a sheath 92 which extends as far as an indicator device 93 placed on the upper front part of the shell attached to a movable indicator 94 which can move in front of a window 93*a* of the housing of the indicator device 93.

Other indication systems, not shown, could alternatively be provided to verify the operation of the heating apparatus for the shoe or boot. For example, an electrical light could be located on the shell base of the shoe or boot which could be activated by a photocell or other type sensor at the burner 3. In such a case, an appropriate replaceable battery could be utilized as a power source.

Figure 15:
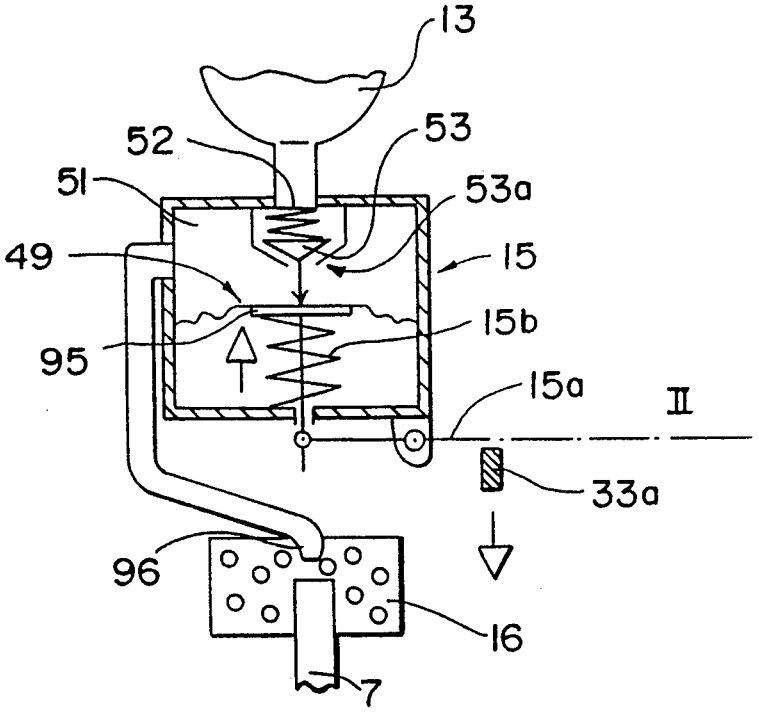
FIG. 15 is an exemplary illustration of the control valve for the gas supply.

FIG. 15 schematically illustrates in particular detail an embodiment of a valve 15 which is contemplated for use with the various embodiments of the heating assembly for a boot or shoe described above.

For placing the valve in the opening position, identified as position II in FIGS. 5 and 7, the pressure-reducing valve 15 includes the following elements: a control pin 15*a* which controls the flow of gas leaving the cartridge and which remains maneuverable from the outside by the skier, a spring 15*b* which biases the plate 95 against the membrane 49 and, as a result, opens a passage to the gas between the valve-pusher 53 and the seat 53*a*; and a plunger spring 52 which continuously biases the valve pusher 53 itself.

In the position II illustrated, the gas expands from the working chamber 51 as far as nozzle 96 where the gas-air mixture is made possible by the intake of air 16 from which extends to the supply nozzle 7 which goes to the burner. The weak flow of gas which can be admitted by the nozzle causes the rise in gas pressure in the working chamber 51. This then leads to the return movement of membrane 49 which pushes the plate 95 and its spring 15*b* and acts on the pin 15*a* which returns in the direction of the "out of service" position I preceding the position II, but without reaching it. As a result, the pressure which exists in the working chamber decreases especially as the intake of gas coming from the cartridge has been decreased by the reduction of the opening between the valve and its seat. This cycle is renewed indefinitely as long as the skier has not intervened on the control pin to place it in the closed position.

In the preceding exemplary description, and throughout the present disclosure, including the claims, any reference to the term "shoe" or "boot" is not intended to limit the invention to any particular type of wearing apparel for the foot, unless express mention is made to the contrary. Accordingly, reference to either term alone, or reference to both terms in the alternative, unless express mention is made to the contrary, is not intended to limit the scope of the present invention. For example, "shoe", "boot", "shoe and boot" are to be taken as equivalents. Likewise, "ski shoe", "ski boot", and "ski shoe or boot" are to be taken as equivalents.

Although the present invention has been described in terms of particular embodiments, comprising particular combinations of elements, materials, and functions, modifications can be made without departing from the scope of the invention defined by the following claims.

We claim:

1. A ski shoe or boot having a foot support zone, a sole, and an upper, said upper including a rear part, said shoe or boot further including a heating assembly, at least a portion of said heating assembly being located proximate said sole, said heating assembly comprising a catalytic burner for producing heat, an electrode positioned proximate said catalytic burner, an igniter functionally connected to said electrode, and a pusher for activating said igniter, a plate for diffusion of said heat, said plate located proximate said foot support zone, means for receiving a source of fuel, a supply circuit for feeding said fuel to said catalytic burner, a valve for regulating said feeding of said fuel from said source of fuel to said catalytic burner, and a heating control device, wherein said means for receiving a source of fuel comprises means for receiving and holding an interchangeable fuel cartridge, comprising a housing provided on said rear part of said upper of said shoe or boot in position for connecting said interchangeable fuel cartridge to said supply circuit, said igniter being positioned proximate said housing, said housing further comprising an upper end, said boot further including a cover movably mounted with respect to said upper end of said housing and being adapted to engage an upper portion of said fuel cartridge and said pusher.

2. A shoe or boot according to claim 1 wherein said upper of said shoe or boot comprises a rear portion and a rear spoiler journalled about a horizontal and transverse axis on said rear portion, wherein said housing for said fuel cartridge is located on rear spoiler.

3. A shoe or boot according to claim 2 wherein said housing for said fuel cartridge is molded with said rear spoiler.

4. A shoe or boot according to claim 1 wherein said housing for said fuel cartridge and further comprises an open end through which said fuel cartridge is insertable and for permitting a fuel outlet of said fuel cartridge to be directed towards the bottom of said housing.

5. A shoe or boot according to claim 1 further comprising means for introducing ambient air into said supply circuit for providing a fuel-air mixture for combustion, said means for introducing ambient air being located beneath said housing and proximate said valve.

6. A ski shoe or boot having a foot support zone, a sole, and an upper, said upper including a rear part, said shoe or boot further including a heating assembly, at least a portion of said heating assembly being located proximate said sole, said heating assembly comprising a catalytic burner for producing heat, a plate for diffusion of said heat, said plate located proximate said foot support zone, means for receiving a source of fuel, a supply circuit for feeding said fuel to said catalytic burner, a valve for regulating said feeding of said fuel from said source of fuel to said catalytic burner, and a heating control device, wherein said means for receiving a source of fuel comprises means for receiving and holding an interchangeable fuel cartridge, comprising a housing provided on said rear part of said upper of said shoe or boot in position for connecting said interchangeable fuel cartridge to said supply circuit, said shoe or boot further comprising means for introducing ambient air into said supply circuit for providing a fuel-air mixture for combustion, said means for introducing ambient air being located beneath said housing and proximate said valve, wherein said housing comprises a lower end, wherein a piston is slidably mounted in said housing and a compression spring being positioned between said piston and said lower end of said housing, said valve being positioned in a central part of said piston, said valve having an outlet connected to said means for introducing ambient air into said supply circuit.

7. A shoe or boot according to claim 6 wherein said means for introducing ambient air into said supply circuit communicates with the exterior of said shoe or boot by means of at least one opening provided in said housing, each of said at least one opening being provided with a filtering element made of a material permeable to air but impermeable to foreign matter.

8. A ski shoe or boot having a foot support zone, a sole, and an upper, said upper including a rear part, said shoe or boot further including a heating assembly, at least a portion of said heating assembly being located proximate said sole, said heating assembly comprising a catalytic burner for producing heat, a plate for diffusion of said heat, said plate located proximate said foot support zone, means for receiving a source of fuel, a supply circuit for feeding said fuel to said catalytic burner, a valve for regulating said feeding of said fuel from said source of fuel to said catalytic burner, and a heating control device, wherein said means for receiving a source of fuel comprises means for receiving and holding an interchangeable fuel cartridge, comprising a housing provided on said rear part of said upper of said shoe or boot in position for connecting said interchangeable fuel cartridge to said supply circuit, wherein said heating assembly further comprises: (i) an igniting electrode positioned near said catalytic burner, and (ii) a piezoelectric igniter connected to said igniting electrode, whereby activation of said piezoelectric igniter ignites said igniting electrode, wherein said heating control device comprises (i) a control knob which is movable substantially vertically outside said rear part of said upper of said shoe or boot, and (ii) a lug extending through a slot in said rear part of said upper, said control knob being affixed to said lug, said lug being movable among three different positions, said three positions consisting of an extreme upper position I, corresponding to the closure of said valve to prevent said feeding of said fuel to said catalytic burner, an intermediate position II, corresponding to the opening of said valve for permitting said feeding of said fuel to said catalytic burner, and an extreme lower position III, corresponding to said activation of said piezoelectric igniter.

9. A shoe or boot according to claim 8 wherein said valve comprises a control arm extending therefrom and wherein said heating control device further comprises, within said upper of the shoe or boot, a manual release plate which is generally C-shaped and open towards the rear and having an upper, generally horizontal wing extending outside of said upper and being comprised of said lug which supports said control knob, said heating control device further comprising a latching plate attached to said manual release plate, said latching plate being generally C-shaped and open towards the rear, said latching plate having an upper generally horizontal wing, said latching plate supporting means for activation of said control arm of said valve for regulating said feeding of said fuel from said interchangeable fuel cartridge, said upper of said shoe or boot further comprising a catch, and said latching plate further comprising a latching mechanism adapted to cooperate with said catch for holding said valve in an open position, said heating control device further comprising a spring positioned to bias said manual release plate and said latching plate upwardly, said manual release plate and said latching plate being linked to one another by means for allowing a limited upward movement of said manual release plate with respect to said latching plate.

10. A shoe or boot according to claim 9 wherein said means for allowing a limited upward movement of said manual release plate with respect to said latching plate comprises guide pins provided on one of said plates engaged within slots provided in the other of said plates, said slots being generally vertically aligned.

11. A shoe or boot according to claim 9 wherein said upper of said shoe or boot further comprises a projection and wherein said spring extends between said projection and said upper, generally horizontal wing of said manual release plate and said upper, generally horizontal wing of said latching plate.

12. A shoe or boot according to claim 11 wherein each of said plates comprises a lower wing which extends beneath said projection of said upper and which is adapted to abut against this projection in said extreme upper position of said lug.

13. A shoe or boot according to claim 9 further comprising a spring located within said valve for biasing said control arm and said valve towards a lower open position wherein said means for activation of said control arm of said valve comprises a projecting lug which extends beneath said control arm.

14. A shoe or boot according to claim 9 further comprising a support affixed to the interior of said upper having a projection extending therefrom for supporting an end of said spring, said igniter also being affixed to said support.

15. A shoe or boot according to claim 9 wherein said latching mechanism of said latching plate comprises a hook and wherein said catch comprises a latching spring having the general shape of an inverted U with an upper generally horizontal member which is adapted to be engaged by said hook of said latching plate, said latching spring being affixed to a lower part of said shoe or boot, said manual release plate including a release ramp at a lower end, said release ramp having a shape such that, during downward movement of said manual release plate, said release ramp is adapted to push said upper generally horizontal member of said inverted U of said latching spring to permit said latching hook of said latching plate to disengage from said generally horizontal member of said inverted U of said latching spring.

16. A shoe or boot according to claim 15 wherein said piezoelectric igniter comprises an upper pushing element for activating said igniter and wherein said manual release plate supports, at an upper end, a member in the shape of an angle iron having a generally vertical portion and a generally horizontal portion, said angle iron-shaped member being affixed to said release plate by said generally vertical portion, said generally horizontal portion extending a short distance, in said extreme upper position I of said lug, above said upper pushing element of the piezoelectric igniter.

17. A shoe or boot according to claim 9 wherein said upper comprises a projection, wherein said piezoelectric igniter comprises an upper pushing element for activating said igniter, wherein said manual release plate comprises a lower, generally horizontal wing which extends beneath said projection and above said upper pushing element of said piezoelectric igniter, and wherein said manual release plate further comprises an upwardly extending lug and wherein said latching plate supports, at its extreme upper part, a latching member which is pivotably mounted on said latching plate, about a generally horizontal and transverse axis, said latching member comprising a lower arm with which an upper end of said lug is adapted to contact, and an upper arm which extends upwardly and which is adapted to engage a tooth mounted on an internal surface of a rear wall of said upper, said latching member being elastically biased by means of a spring having two ends which are contacted, respectively, to said latching plate and to said latching member such that said upper arm of said latching member is constantly biased against said rear wall of said upper.

18. A shoe or boot according to claim 1 further comprising means for automatically maintaining the temperature of said heating assembly above a predetermined level.

19. A shoe or boot according to claim 18 wherein said means for maintaining the temperature of said heating assembly above a predetermined level comprises a closed circuit containing a dilatable fluid, said closed circuit comprising (i) a bulb positioned proximate said catalytic burner at one end of said closed circuit, (ii) a diaphragm actuator at another end of said closed circuit, and (iii) a capillary tube extending between said bulb and said diaphragm, said diaphragm actuator comprising a housing which is separated into a first chamber and a second chamber by a deformable diaphragm, said capillary tube containing said dilatable fluid being connected to said first chamber, said second chamber having a return spring operatively associated with said diaphragm and a plunger affixed to said diaphragm and having an external end positioned outside of said housing of said actuator, said means for maintaining the temperature of said heating assembly above a predetermined level further comprising a linkage device positioned between said plunger and said valve for regulating said feeding of said fuel.

20. A shoe or boot according to claim 19 wherein said valve comprises a control arm extending therefrom for controlling the opening and closing of said valve, said control arm being spring biased towards an open position of said valve, wherein said means for maintaining the temperature of said heating assembly above a predetermined level further comprises a two-armed pivotably mounted lever, wherein said external end of said plunger is in contact with a first arm of said lever and said control arm is in contact with a second arm of said lever.

21. A shoe or boot according to claim 19 wherein said means for maintaining the temperature of said heating assembly above a predetermined level comprises a first plunger arm and a second plunger arm extending from said plunger outside of said housing of said actuator, wherein said first plunger arm, in a closed fuel position, is adapted to maintain immobilized, between said first plunger arm and said housing of said actuator, a generally horizontal wing of a control member, said control member further comprising a generally vertical wing extending upwardly and which is bored with an opening through which extends a first arm of a lever journalled above a generally horizontal axis, a second arm of said lever extending above said external end of said plunger, said first lever arm being connected to a generally vertical control slide valve which is biased upwardly by a return spring and which can be positioned on a seat, positioned beneath it, which constitutes the orifice of a fuel supply conduit and which is interposed on the fuel flow path from the supply conduit as far as said catalytic burner, and wherein said means for maintaining the temperature of said heating assembly above a predetermined level further comprises a cam which is pivotably mounted and spring-biased to a rest position, said cam being adapted to control the opening said valve, said cam being positioned beneath said second plunger arm and extending beyond said housing of said actuator for lifting said second plunger arm and, consequently, said plunger, by manual rotation of said cam.

22. A shoe or boot according to claim 18 wherein said means for maintaining the temperature of said heating assembly above a predetermined level includes a bimetallic strip which is fixed a lower end and which is inclined on one side with respect to the vertical, while being in contact, in a stop position of said valve, with a closed maintenance arm solidly affixed to a first end of a generally horizontal lower control rod, a manually manipulable cam which is positioned in the immediate proximity of the upper portion of said bimetallic strip, thereby being adapted to straighten said bimetallic strip into a generally rectilinear vertical position, said generally horizontal lower control rod being slidably mounted generally horizontally, and a second end of said control rod being journalled at the end of the lower arm of a lever which is journalled about a generally horizontal axis and whose upper arm is connected, at a point in its length, to an upper control rod slidably mounted generally horizontally, facing the upper portion of said bimetallic strip, said upper arm of said lever being coupled to a piston slidably mounted generally horizontally in a bore formed in a valve member and into which opens a lateral conduit connected to said catalytic burner, said piston being constantly biased towards the exterior by a return spring, and supporting, on a front internal surface, a joint for sealing a seat of said valve provided at the point of the orifice of a fuel supply conduit provided in the valve body, coaxially with said piston.

23. A shoe or boot according to claim 1 further comprising means for visually verifying the operation of said burner comprising an indicator device positioned on said shoe or boot.

24. A ski shoe or boot having a foot support zone, a sole, and an upper, including a heating assembly, at least a portion of said heating assembly being located proximate said sole, said heating assembly comprising a catalytic burner for producing heat, a plate for diffusion of said heat, said plate located proximate said foot support zone, means for receiving a source of fuel, a supply circuit for feeding said fuel to said catalytic burner, a valve for regulating said feeding of said fuel from said source of fuel to said catalytic burner, and a heating control device, wherein said means for receiving a source of fuel comprises means for receiving and holding an interchangeable fuel cartridge provided on said upper of said shoe or boot in position for connecting said interchangeable fuel cartridge to said supply circuit, said shoe or boot further comprising means for visually verifying the operation of said burner, comprising an indicator device positioned on said shoe or boot, wherein said means for visually verifying the operation of said burner comprises an optical sensor which is positioned proximate said burner and an optical fiber connecting said optical sensor to said indicator device.

25. A ski shoe or boot having a foot support zone, a sole, and an upper, including a heating assembly, at least a portion of said heating assembly being located proximate said sole, said heating assembly comprising a catalytic burner for producing heat, a plate for diffusion of said heat, said plate located proximate said foot support zone, means for receiving a source of fuel, a supply circuit for feeding said fuel to said catalytic burner, a valve for regulating said feeding of said fuel from said source of fuel to said catalytic burner, and a heating control device, wherein said means for receiving a source of fuel comprises means for receiving and holding an interchangeable fuel cartridge provided on said upper of said shoe or boot in position for connecting said interchangeable fuel cartridge to said supply circuit, said shoe or boot further comprising means for visually verifying the operation of said burner, comprising an indicator device positioned on said shoe or boot, wherein said means for visually verifying the operation of said burner comprises, in the immediate proximity of said burner, a bulb which is connected, by a capillary tube, to said indicator device, said bulb and said capillary tube containing a dilatable, wherein said fluid is adapted to dilate when the temperature of the burner is raised, causing a displacement of a movable index in front of a window of said indicator device.

26. A ski shoe or boot having a foot support zone, a sole, and an upper, including a heating assembly, at least a portion of said heating assembly being located proximate said sole, said heating assembly comprising a catalytic burner for producing heat, a plate for diffusion of said heat, said plate located proximate said foot support zone, means for receiving a source of fuel, a supply circuit for feeding said fuel to said catalytic burner, a valve for regulating said feeding of said fuel from said source of fuel to said catalytic burner, and a heating control device, wherein said means for receiving a source of fuel comprises means for receiving and holding an interchangeable fuel cartridge provided on said upper of said shoe or boot in position for connecting said interchangeable fuel cartridge to said supply circuit, said shoe or boot further comprising means for visually verifying the operation of said burner, comprising an indicator device positioned on said shoe or boot, wherein said means for visually verifying the operation of said burner comprises a bimetallic strip extending in close proximity to said burner so as to be able to be heated by said burner, said bimetallic strip engaging one end of an arm of a two-armed lever which is journalled about an axis and whose second arm is connected to one end of a flexible cable which is slidably contained within a sheath, said cable extending to said indicator device, wherein said indicator device comprises a housing having a window within which a movable indicator moves and wherein another end of said cable is attached to said movable indicator for moving said movable indicator.

27. A shoe or boot according to claim 1 wherein said fuel is gaseous.

28. A shoe or boot according to claim 1 wherein said shoe or boot comprises an outer shell and wherein said means for receiving and holding said fuel cartridge is located within said outer shell.

29. A shoe or boot according to claim 1 wherein said shoe or boot comprises an outer shell and wherein said means for receiving and holding said fuel cartridge is located exteriorly of said outer shell.

30. A shoe or boot according to claim 23 wherein said means for visually verifying the operation of said burner is located on the upper front of said shoe or boot.

31. A boot comprising a sole, an upper, and a heating assembly, said upper including a portion for receiving and holding a source of fuel for said heating assembly, said heating assembly comprising a supply circuit, said supply circuit extending from said portion of said upper to an area proximate said sole, at least a portion of said heating assembly being located proximate said sole, said heating assembly further comprising a fuel fed heating device located beneath said sole, wherein said supply circuit comprises a supply tube extending between said portion of said upper and said heating device, said boot further comprising a manually manipulable valve for controlling feeding of said fuel from said fuel source to said heating device, said valve being movable between an open position and a closed position, said boot further comprising a finger engageable knob movable among three positions including a first, valve closed, starting means actuated position; a second, valve opened, starting means unactuated position; and a third, valve opened, starting means actuated state position, wherein said heating device is a catalytic burner, said heating assembly further comprising an electrode positioned proximate said catalytic burner, and wherein said starting means is an igniter for providing a spark to said electrode for igniting said catalytic burner.

32. A boot according to claim 31 wherein at least said upper is molded from a plastic material, and wherein said portion of said upper comprises a housing which is molded integrally with said upper.

33. A boot according to claim 31 wherein said portion of said upper is a rear portion of said boot.

34. A boot according to claim 31 wherein said boot is a rear-entry ski boot comprising a rear spoiler and wherein said portion of said upper is located on said rear spoiler.

35. A boot according to claim 31 wherein said portion of said upper comprises a housing having a first opening through which a fuel cartridge is insertable and a second opening through which a fuel outlet of said fuel cartridge is to be directed.

36. A boot according to claim 35 comprising a removable cap for closing said first opening.

37. A boot according to claim 36 wherein said first opening is located in an upper portion of said housing.

38. A boot according to claim 31 comprising a member located exteriorly of said upper for starting a heating operation of said heating assembly.

39. A boot according to claim 31 wherein said valve is movable between an open position and a closed position.

40. A boot according to claim 39 comprising a finger engageable knob for moving said valve between said open and closed positions.

41. A boot according to claim 31 wherein said valve is located proximate said portion of said upper.

42. A boot according to claim 31 comprising means for automatically maintaining the temperature of said heating device above a predetermined level.

43. A boot according to claim 42 comprising a valve for regulating the feeding of said fuel from said fuel source to said heating device, wherein said means for automatically maintaining the temperature of said heating assembly above a predetermined level comprises a closed circuit containing a dilatable fluid, said closed circuit including a bulb positioned proximate said heating device, a diaphragm actuator operatively associated with said valve for controlling the feeding of said fuel from said fuel source to said heating device, and a tube extending from said bulb to said diaphragm actuator.

44. A boot according to claim 42 comprising a valve for regulating the feeding of said fuel from said fuel source to said heating device, wherein said means for automatically maintaining the temperature of said heating assembly above a predetermined level comprises (i) a bimetallic member having a fixed portion and a movable portion, said movable portion being positioned proximate said heating device, (ii) and a linkage assembly operatively associated with said movable portion of said bimetallic member and said valve for controlling the feeding of said fuel from said fuel source to said heating device.

45. A boot according to claim 31 further comprising means for enabling visually verifying the operation of said heating assembly.

46. A boot according to claim 45 wherein said enabling means comprising an indicator positioned on said boot.

47. A boot comprising a sole and an upper, said upper including a portion for receiving and holding a source of fuel for a heating assembly, said boot further comprising a heating assembly having a supply circuit and comprising a heating device located beneath said sole, said supply circuit extending from said portion of said upper to an area proximate said sole, at least a portion of said heating assembly being located proximate said sole, said boot further comprising means for enabling visual verification of the operation of said heating assembly comprising a sensor located proximate said heating device and means for operatively connecting said indicator and said sensor.

48. A shoe or boot according to claim 4 wherein said fuel cartridge has a shape selected from the group consisting of prismatic and cylindrical.

* * * * *